US005265444A

United States Patent [19]

Martin

[11] Patent Number: 5,265,444

[45] Date of Patent: Nov. 30, 1993

[54] INVERTED FRUSTUM SHAPED MICROWAVE HEAT EXCHANGER USING A MICROWAVE SOURCE WITH MULTIPLE MAGNETRONS AND APPLICATIONS THEREOF

[76] Inventor: William A. Martin, 124 Elma-McCleary Rd., #38, Elma, Wash. 98541

[21] Appl. No.: 43,025

[22] Filed: Apr. 5, 1993

Related U.S. Application Data

[60] Division of Ser. No. 953,090, Sep. 29, 1992, which is a division of Ser. No. 547,181, Jul. 3, 1990, Pat. No. 5,179,259, which is a continuation-in-part of Ser. No. 187,723, Apr. 29, 1988, Pat. No. 4,956,534.

[51] Int. Cl.[5] ..... H05B 6/80; F25B 39/00

[52] U.S. Cl. ..... 62/515; 62/157; 165/14; 219/10.55 R; 219/10.55 B

[58] Field of Search ..... 219/10.55 A, 10.55 R, 219/10.55 B; 62/157, 159, 132, 515, 524; 165/14, 48.1, 58

[56] References Cited

U.S. PATENT DOCUMENTS

| | | | |
|---|---|---|---|
| 4,156,454 | 5/1979 | Skala | 165/2 |
| 4,358,652 | 11/1982 | Kaarup | 219/10.55 A |
| 4,590,684 | 5/1986 | Arsem | 62/74 |
| 4,922,731 | 5/1990 | Russell et al. | 62/515 |
| 4,956,534 | 9/1990 | Martin | 219/10.55 A |

OTHER PUBLICATIONS

Baumeister & Marks, *Standard Handbook for Mechanical Engineer*, Seventh Edition, 1967, McGraw-Hill, pp. 8-13 and 8-14.

*Primary Examiner*—Philip H. Leung

*Attorney, Agent, or Firm*—Sterne, Kessler, Goldstein & Fox

[57] ABSTRACT

A microwave sourced heat exchanger in an inverted, truncated frusta-pyramidal or frusta-conical shaped configuration. A heat conductive medium is carried within microwave transparent pipes toward a microwave source having one or more magnetrons along a split path of increasing parameter. The magnetrons sequentially operate in a cyclic pattern such that the respective magnetrons do not operate when their respective operating temperatures exceed their respective maximum safe operating temperatures. The sequential use of multiple magnetrons increases the efficiency and operating life of the magnetrons. The geometrical design of the microwave heat exchanger allows the heat conductive medium anywhere in the conduit to be directly exposed to microwaves. Further, the geometry of the microwave heat exchanger induces a thermal siphon when the heat conductive medium within is exposed to a microwave source placed at the exchanger's broader base. This thermal siphon effect allows for elimination or reduction in size of a circulating motor.

4 Claims, 13 Drawing Sheets

INVERTED FRUSTUM SHAPED MICROWAVE HEAT EXCHANGER USING A MICROWAVE SOURCE WITH MULTIPLE MAGNETRONS AND APPLICATIONS THEREOF

This is a divisional application of U.S. patent application Ser. No. 07/953,090, filed Sep. 29, 1992, which is a divisional application of U.S. patent application Ser. No. 07/547,181, filed Jul. 3, 1990, now U.S. Pat. No. 5,179,259, which is a continuation-in-part of U.S. patent application Ser. No. 07/187,723, filed Apr. 29, 1988, now U.S. Pat. No. 4,956,534.

BACKGROUND OF THE INVENTION

1. Field of the Invention

The present invention relates to heat exchangers. In particular, it relates to heat exchangers that make use of microwaves as the energy source.

2. Related Art

In general, heat exchangers are devices used to transfer heat from one heat conductive medium or source to another. The heat supplied from the medium to the heat exchanger may come from a variety of sources, for example, the burning of gas, oil, or coal. Another source of energy is electricity.

One source of energy that has been of interest in recent years is microwave energy. In a typical microwave heat exchanger, microwaves emitted from a microwave source are absorbed by a fluid carried within one or more microwave transparent pipes. The fluid heated by the absorbed microwave energy is then transported to the area to be heated by the fluid. The fluid may be used either to transfer heat indirectly, for example, by convection, or it may be used to directly transfer heat.

One consideration involved in the design of microwave heat exchangers is geometry. In order to allow for the efficient absorption of microwave energy, such heat exchangers are designed so as to allow the heat conductive medium a reasonable amount of exposure to the microwave energy. Representative examples of microwave heat exchanger configurations may be seen in the helical path used in U.S. Pat. No. 3,778,578 (Long et al.) and in the parallel paths used in U.S. Pat. No. 4,417,116 (Black).

The inventor has discovered that conventional microwave heat exchangers suffer from reduced efficiency due to the shadow created by the heat exchange medium (i.e., the fluid or gas within the microwave transparent pipes or conduits). Medium closer to the microwave source absorbs microwave energy and thus "shadows" the medium in the pipes at lower levels (i.e., further from the microwave source). The inventor has discovered that the lack of efficiency created by this "shadow" effect increases energy consumption, and necessitates the use of additional or larger capacity heating equipment. Such shadowing can be readily conceptualized by observing the geometry of parallel path and straight helical (cylindrical) heat exchanger.

Conventional microwave heat exchanges also suffer from another type of shadowing problem. The inventor has discovered that medium carried within any given level of the microwave-transparent pipe or conduit also has a tendency to "shadow" itself. That is, the portion of the medium which is carried closer to the microwave source tends to absorb the majority of the delivered energy. This absorption causes the medium on the side of the conduit closer to the source to become more excited than the medium on the other or farther away side of the same section of conduit.

The inventor believes that efforts to deal with this problem by merely reducing the inner diameter of the microwave transparent conduit frustrates the goal of maintaining the volumetric capacity of the microwave heat exchanger. Further, if parallel conduit sections are used to make up for loss in volumetric capacity, for example, the resulting structure may suffer from problems caused by the shadowing from pipe to pipe.

In order to operate, heat exchangers circulate or move the heat conductive medium from source to destination. In order to accomplish this movement of the medium, conventional microwave heat exchangers often use a mechanical pump. Typically, this mechanical pump is placed along the medium path and may be the only mechanism for circulation of the medium. Any mechanical pump exhibits a certain probability of mechanical breakdown. In addition to increasing hardware costs, such a mechanical pump may increase energy consumption of the system, thus reducing efficiency. A non-pump method of moving the heat conductive medium, that is both efficient and inexpensive, would be desirable.

As stated above, conventional microwave heat exchangers receive microwaves from microwave sources. A conventional microwave source contains a single magnetron unit. Magnetron units are designed to operate over a safe operating temperature range. Operation outside the safe operating temperature range results in efficiency degradation and premature failure of the magnetron units. Thus, in applications which require a continuous supply of microwaves from the microwave source, the use of a single magnetron is inefficient and expensive if the magnetron unit is required to operate beyond its safe operating temperature range.

Microwave heat exchangers may be put to many uses or applications. It is known that microwave energy may be used in hot water heating applications. See, for example, U.S. Pat. No. 4,029,927. In this patent, for example, microwave energy applied to the entire volume of water in the hot water tank. Conventional devices which attempt to heat a large volume of water directly suffer from the deficiency caused by the absorption of microwave energy by the water that is close to the microwave source.

SUMMARY OF THE INVENTION

One objective of this invention is to provide a microwave heat exchanger that makes efficient use of microwave energy and is of flexible capacity. Another object of this invention is to provide a microwave heat exchanger that can transport microwave induced heat from source to a destination without the use of a motor if desired. A further object of this invention is to provide a microwave heat exchanger that may be easily used both in residential and commercial heating, cooling and hot-water systems. An additional object of this invention is to provide a microwave source with multiple magnetrons so as to increase the efficiency and longevity of the magnetrons.

The invention comprises a system and method for microwave-sourced heat exchange, which uses a geometrical design calculated to reduce or eliminate "shadow" and to produce medium movement through the inducement of a thermal syphon.

The system makes use of microwave-transparent tubing to lead a heat conductive medium toward a microwave source along a path of increasing perimeter. The shape of the heat exchanger formed by this tubing allows for the direct exposure of the heat conductive medium to microwaves at any distance from the source. The heat exchanger thereby eliminates or reduces the shadow created by the medium carried within the tubing. Further, the shape of the heat exchanger induces a thermal siphon when microwaves are applied to the medium within. This induced thermal siphon may be used to move the heat conductive medium from source to destination without the aid of an in line motor.

In one preferred embodiment, the microwave heat exchanger is configured in the shape of an inverted pyramidal frustum (also referred to as a frusta-pyramid for purposes of this specification). For the purposes of this specification, a pyramidal frusutum or frusta-pyramid is the shape of a section of a pyramid between the base and a plane parallel to the base (i.e. a pyramid with its tip sliced off). A frusta-pyramid will therefore have a broader base, (the original pyramid base), and a narrower base (the base exposed by slicing of off the tip).

In the above-described embodiment, water enters the heat exchanger at its smaller base through a single inlet pipe. As it enters the base of the heat exchanger, the water flow is split into two pipes of a diameter equal to that of the inlet pipe. One pipe leads the water around a rectangular shaped flow path at the base. A second pipe leads the water up and above the first pipe but in a rectangle of slightly wider perimeter. The two microwave-transparent pipes continue around as a pair in this pattern of gradually increasing perimeter with the second water flow path always slightly wider than the first water flow path. The two pipes rejoin at the top or broad base of the heat exchanger. In this embodiment, the path of flow is gradually broadened so as to form a 30° rectangular inverted frusta-pyramid.

The inverted, frusta-pyramidal shape formed by the pipes allows heat exchanger to produce dramatically superior results over known heat exchangers. This is accompanied by optimizing the exposed functional area of the heat exchanger, eliminating the shadow effect from pipe to pipe, eliminating the shadow effect created by the media itself within each pipe, and by utilizing the thermal siphon effect to aid in the flow of the heat conductive media.

When the inverted frusta-pyramidal heat exchanger was used in a hot water heating system, unexpected and superior results were obtained. The heat exchanger was able-to provide hot water at significant energy savings as compared with conventional hot water heating units. In addition, the heat exchanger was able to heat hot water 20% more efficiently than conventional in line rectangular-serpentine microwave heat exchangers.

The inventors have discovered that the thermal siphon effect induced by the unusual shape of the inventive heat exchanger enables its operation within a residential hot water heating system without a mechanical motor. In cases where a motor is added to increase the flow rate, the thermal siphon effect induced by the heat exchanger provides a significant advantage. The thermal siphon effect enables the heat exchanger to operate using a lower wattage electrical motor than would be practical using serpentine or helical heat exchangers.

Advantageously, the inverted, frusta-pyramidal heat exchanger may be placed within existing hot water, heating and cooling systems with only inexpensive modifications. Due to the efficiency of the heat exchanger, it may be constructed small enough so as to fit inside a conventional microwave oven which may be modified to act as its microwave source. In this embodiment, the inventive heat exchanger is placed broad base up within the microwave oven so as to be oriented coaxially with the center of the oven magnetron or the furnishing aperture of the wave guide which directs the signal into the microwave oven from the magnetron.

The microwave oven may contain one or more magnetron sets. The magnetron sets may contain one or more magnetrons. The magnetron sets-operate sequentially in a cyclic pattern (the magnetrons within a magnetron set operate in parallel when the magnetron set is selected for operation). The use of multiple magnetrons and a cyclic process to operate the magnetrons ensures that the magnetrons operate only while within their safe operating temperature ranges. This results in increased efficiency and longevity of the magnetrons.

In one hot water heating embodiment, the heat exchanger is used as part of a residential/commercial hot water heating system. In this embodiment, the heat exchanger is placed inside a conventional microwave source as described above. Advantageously, a conventional two element hot water tank may be modified for use with the heat exchanger.

It should be understood that the heat exchanger of the present invention may be used in cooperation with any conventional hot water tank. The microwave unit and heat exchanger may be mounted underneath the tank, along its side or in any other position which allows water to flow in the prescribed pattern. The microwave unit should be sealed so that there is no microwave leakage. Such sealing methods are well known in the art.

In a third embodiment the inverted frusta-pyramidal heat exchanger can be used in household or commercial heating applications. In this application, the heat conductive media is circulated through the microwave heat exchanger in a closed path. Along this path the heat conductive medium passes through a conventional copper finned heating coil. Cool air drawn in from the area to be heated is blown through the heating coil by a centrifugal fan and into existing ductwork within the area to be heated. In addition, the flow path is provided with a vented fluid expansion tank which allows the water or other selected fluid used as the heat conductive medium within the system to expand and contract during operation or inactive periods of the system. Although this particular application is for a forced air type of heating unit, the inventive heat exchanger may just as easily be used in a baseboard heating, steam heating, or hot water or other selected fluid heat application.

In a fourth embodiment, the frusta-pyramidal heat exchanger may be used in conjunction with a known ammonia, hydrogen absorption refrigeration system. In this case, a similar configuration to the one described for the home heating system is used. Instead of going into a heating coil, heat is provided to the ammonia, hydrogen cooling system along the heat conductive mediums circulatory path. In this application, DOWTHERM® heat conductive medium, available from the Dow Chemical Company, is preferably used.

It should be understood that, although the shape of the heat exchanger has been referred to as an inverted frusta-pyramid, the device can be any shape whereby piping causes a heat conductive medium to move from a narrow base to a wide base along paths of increasing perimeter and whereby the angle of climb allows for the exposure of the microwaves to each rung of the spiral. For example, an invented, conical frustum shape may also be used where the flexibility of the microwave transparent piping material permits. It should also be understood that an optional pump may be placed at either the inlet or the outlet depending on the application.

BRIEF DESCRIPTION OF THE DRAWINGS

FIG. 5A is a view of the frusta-pyramidal heat exchanger placed within a modified microwave oven having one magnetron.

FIG. 5B is a view of the frusta-pyramidal heat exchanger placed within a modified microwave oven having two magnetrons.

FIG. 5C is a view of the frusta-pyramidal heat exchanger placed within a modified microwave oven having four magnetrons divided into two magnetron sets.

FIG. 5D is a top view illustrating the relative positioning of the four magnetrons from FIG. 5C.

FIG. 5E is a view of the frusta-pyramidal heat exchanger placed within a modified microwave oven having three magnetrons, each magnetron representing a magnetron set.

FIG. 5F is a top view of FIG. 5B showing the frusta-pyramidal heat exchanger and the microwave source having two magnetrons.

DETAILED DESCRIPTION OF THE PREFERRED EMBODIMENTS

Table of Contents

| | |
|---|---|
| I. | General Overview |
| II. | Inverted frusta-pyramidal or frusta-conical Heat Exchanger |
| III. | Residential/Commercial Hot Water Heating Embodiment |
| IV. | Residential/Commercial Heating Embodiments |
| V. | Air Conditioning Embodiment |
| VI. | Conclusion |

I. General Overview

The detailed description of the preferred embodiments is organized into five separate sections. This first section, the General Overview, contains a short description of each of the preferred embodiments of the pyramidal or conical heat exchanger. Section II contains a detailed description of the inverted, frusta-pyramidal heat exchanger and the alternative frusta-conical heat exchanger without reference to any specific application for the invention. Section III is a description of a residential/commercial hot water heating system using the Inverted, Truncated, Pyramidal or Conical Heat Exchanger. Section IV describes an embodiment using the inventive heat exchanger for residential/commercial heating purposes. Section V is a description of an air conditioning system using the inventive heat exchanger within an ammonia, hydrogen absorption refrigeration system. Finally, Section VI contains a short conclusion.

II. Inverted frusta-pyramidal or frusta-conical Heat Exchanger

The invention is a system and method for microwave-sourced heat exchange, which uses a geometrical design calculated to reduce or eliminate "shadow" and to produce medium movement through the inducement of a thermal syphon.

The invention makes use of microwave-transparent tubing to lead a heat conductive medium toward a microwave source along a path of increasing perimeter. The shape of the beat exchanger formed by this tubing allows for the direct exposure of the heat conductive medium to microwaves at any distance from the source. The inventive beat exchanger thereby eliminates or reduces the shadow created by the medium carried within the tubing. Further, the shape of the inventive heat exchanger induces a thermal siphon when microwaves are applied to the medium within. This induced thermal siphon may be used to move the heat conductive medium from source to destination without the aid of an in line motor.

Figure 8:
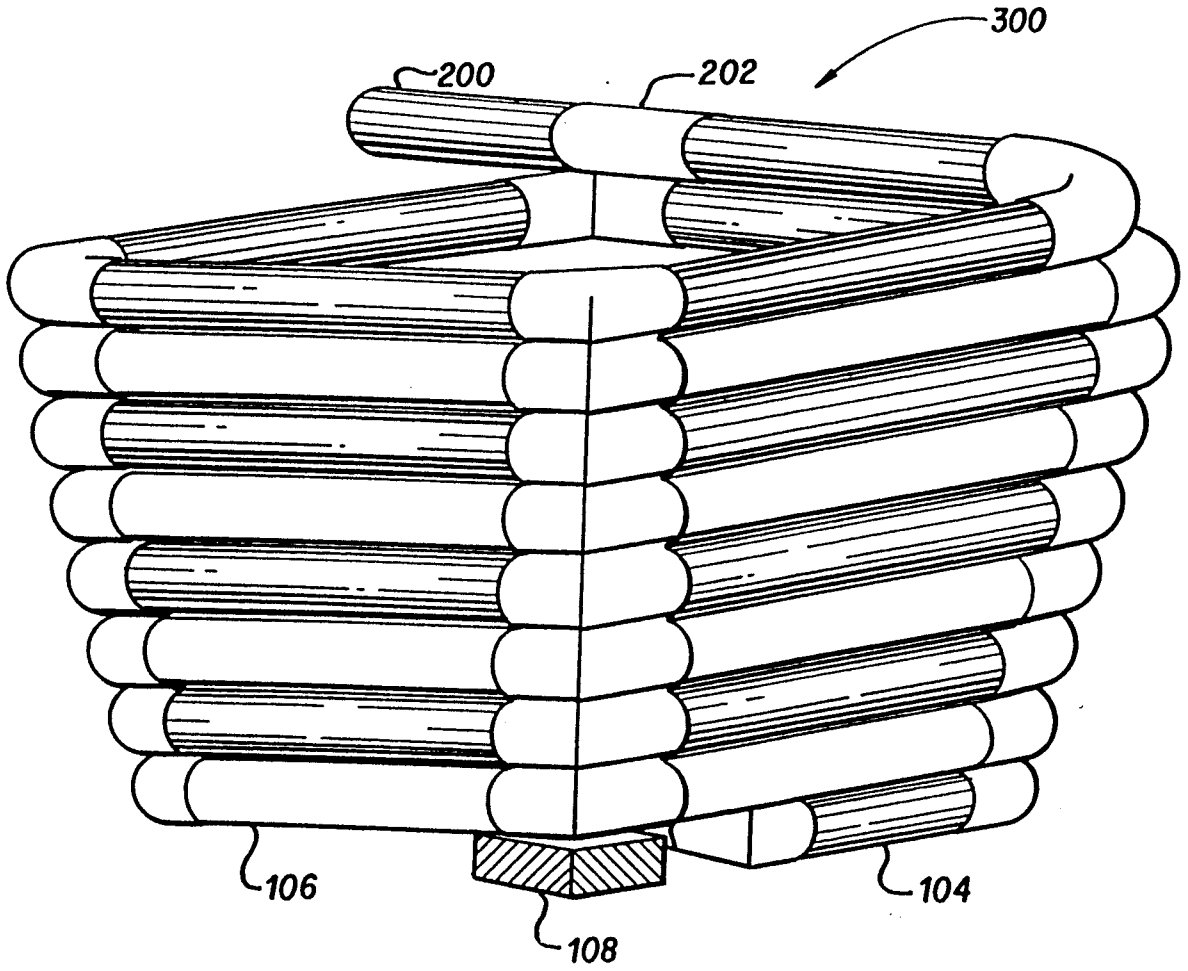
FIG. 8 is a perspective view of the inverted, frusta-pyramidal heat exchanger.

The general shape of the heat exchanger may best be seen by reference to FIG. 8. The inventive heat exchanger (generally referred to by reference numeral 300) is shown in a perspective view. From this view it may be seen that the heat exchanger is in the general shape of an inverted, pyramidal frustum (a frusta-pyramid).

Figure 3:
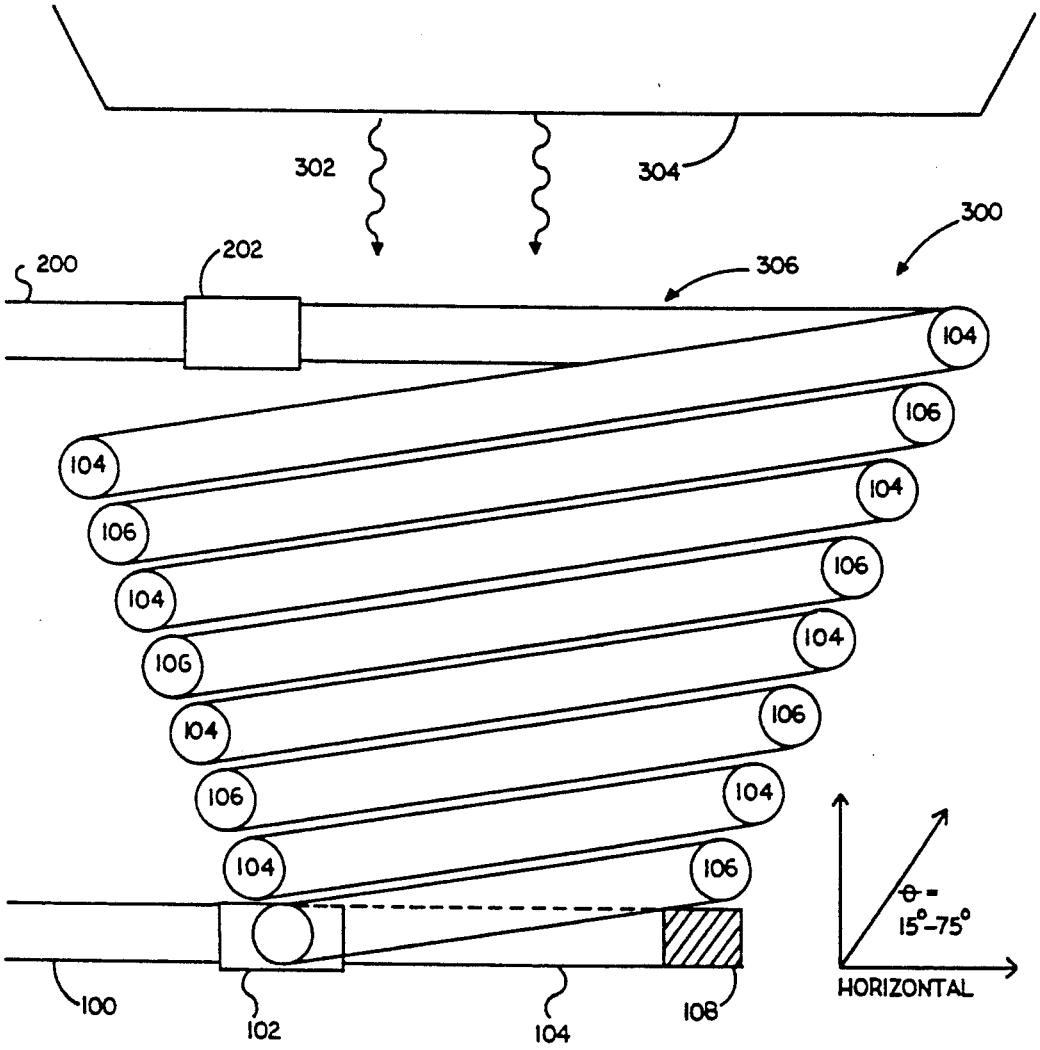
FIG. 3 is a front view of the frusta-pyramidal heat exchanger.

Looking now at FIG. 3, it will be observed that the sides of the beat exchanger angle outwardly at an angle $\theta$ from 15°–75° from the horizontal. It may also be seen from FIG. 3, that while the inventive heat exchanger has one inlet pipe 100 and one outlet pipe 200, the heat exchanger itself is made up of two separate pipes (pipe 104 and pipe 106) which climb as a pair.

In order to form the two separate pipes, (pipe 104 and pipe 106), a single inlet pipe 100 is split into two separate flow paths at the base of the heat exchanger. The split of the single inlet 100 into two pipes may be best seen by reference to FIG. 1. The inlet 100 enters the heat exchanger at the inlet tee 102 where it is split into two separate pipes 104, 106. The first pipe 106 is constructed so as to form a larger perimeter than, and to rest above the second pipe 104. The orientation of the pipes creates the outward angle $\theta$ as seen in FIG. 3.

A first block 108 is used to support the first pipe 106 in its initial ascent above the second pipe 104. A second block 112 is used to support pipe 106 so that it will ascend above the inlet pipe 100. The first and second pipes 106, 104 climb as a pair, (i.e. one above the other), forming progressively larger spirals as they ascend.

From FIG. 8 it will be observed that on any given level from the narrow base of the heat exchanger, the first pipe 106 forms a somewhat larger spiral than the second pipe 104, below it. In an embodiment tested by the inventors, elbows 110 (see FIG. 1) were used to bend the pipes 104,106 at 90° angles so as to form the spiral shape. It is contemplated by the inventor, however, that all corners and connections may eventually be preformed so as to eliminate the need for elbows and tees.

Figure 2:
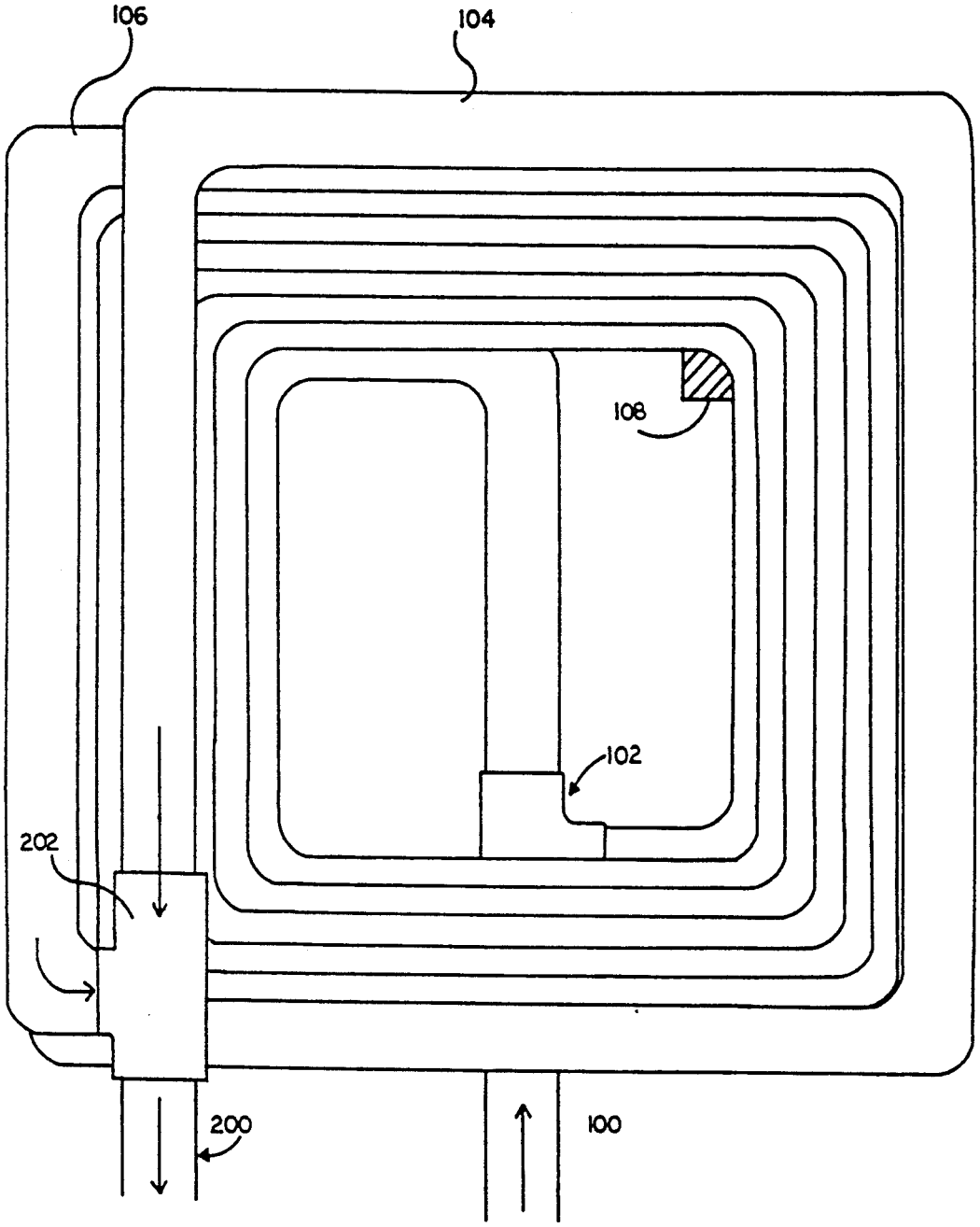
FIG. 2 is a top view of the frusta-pyramidal heat exchanger.

As has been explained, the first and second pipes 106, 104 ascend in a path of increasing spirals. This may be seen more clearly from FIG. 2 which shows a top view of the heat exchanger. When the pipes reach the top, (broader base), of the heat exchanger they are rejoined and formed into a single outlet 200. As may be observed, the first pipe 106 and the second pipe 104 reconnect at the outlet tee 202 so as to form the single outlet 200.

The preferred operation of the heat exchanger will now be described by reference to FIGS. 1 through 5. As may be seen from FIG. 1, heat conductive medium, (represented by arrows), enters the heat exchanger at the inlet pipe 100. When the medium reaches the inlet tee 102 it flow is split into two separate paths. About half of the medium flows through the first pipe 106. The remaining medium flows through the second pipe 104. The medium continues to flow through the pipes in a split path of increasing spirals until it reaches the outlet tee 202. When the medium reaches the outlet tee its flow is recombined into a single flow path. The heat conductive medium then exits the heat exchanger through the outlet pipe 200.

Advantageously, by splitting the flow of the heat conductive medium into two parts and into two pipes which are of the same inner diameter as the single inlet pipe, the depth of the medium penetrated by the microwave energy at each level is increased. This is due to the fact that the heat conductive medium flows more slowly through the exchanger and spends more time at each level. The reduction in the medium's velocity allows for increased efficiency due to the increased time spent under the microwaves emitted from the microwave source. By rejoining the pipes at the broad base of the pyramid, the total volumetric capacity of the heat exchanger remains substantially constant.

Additionally, the split path helps create a greater temperature gradient between alternate flow paths and increases the effectiveness of the exchanger as a thermal siphon. It is this thermal syphon feature which allows for the elimination or reduction in size of the circulating pump found in known heat exchangers. The use of pipes of the same diameter eliminates the increased resistance to flow which might otherwise occur if just one long pipe or thinner piping were used.

The inverted, generally frusta-pyramidal shape of the heat exchanger allows for the efficient use of microwave energy. Again, referring to FIG. 3, the heat exchanger 300 broadens from bottom to top at an angle $\theta$ (15°–75° ) and is irradiated with microwaves 302 at its broader base from microwave source 304. This broadening from bottom to top allows for the direct exposure to microwaves of the heat conductive media within each pipe. The result of direct exposure is that the shadow effect is reduced or eliminated. The preferred value for $\theta$ is 30° from horizontal. Experiments have shown that the optimal range for $\theta$ is from 20° to 60° from horizontal (i.e., 30°–70° from vertical). It should be understood that any angled offset from vertical will improve efficiency albeit not as well as the suggested ranges.

Figure 1:
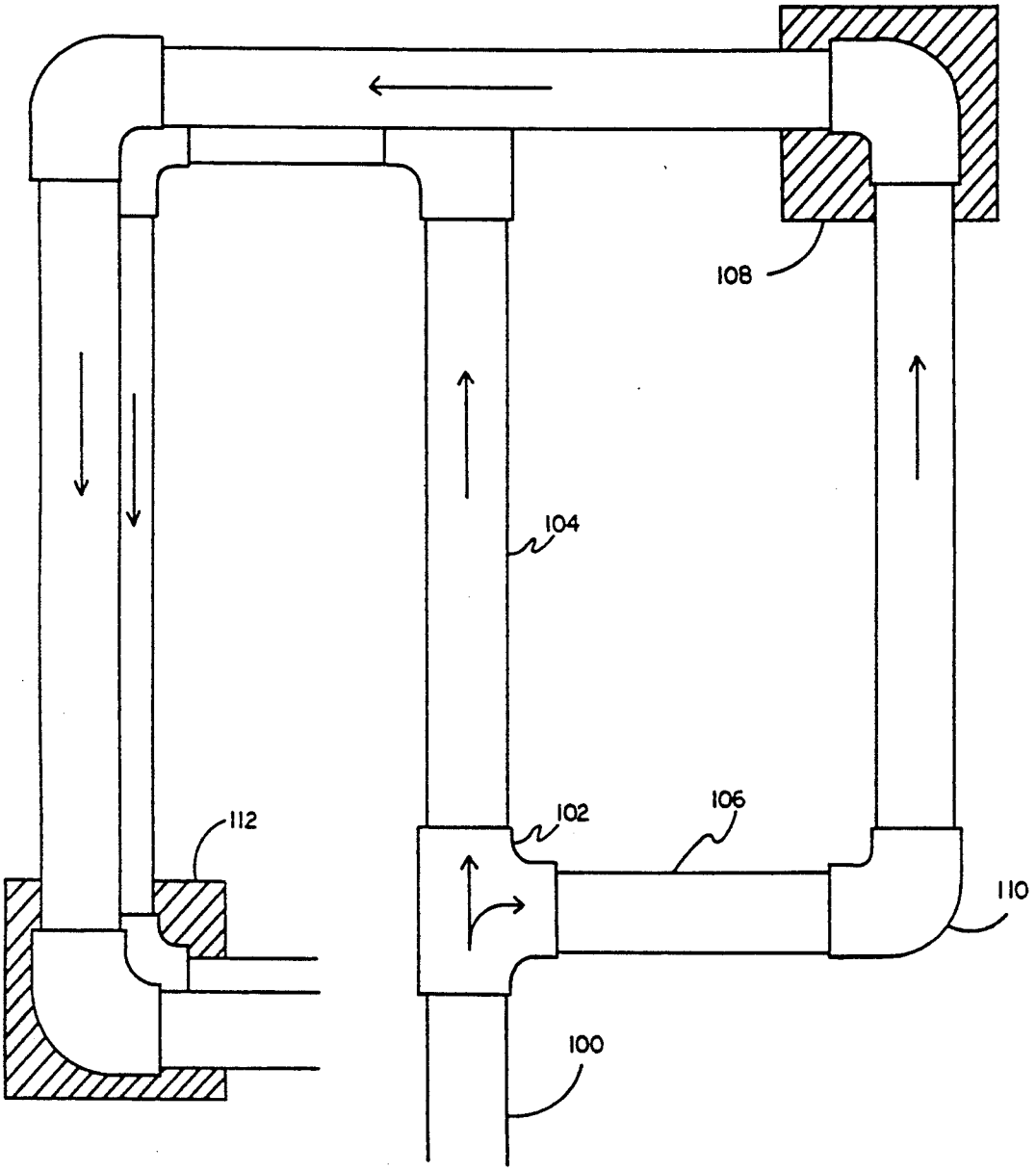
FIG. 1 is a top cut-away view of the inverted frusta-pyramidal heat exchanger showing the bottom (narrower) base section.

Advantageously, the broadening form of the heat exchanger also creates a thermal siphon when an active microwave source is placed at the exchanger's broader base. This thermal siphon allows the heat exchanger to operate without the aid of a pump. Heat conductive medium entering the beat exchanger at its narrow base, shown in FIG. 1, is cooler, more dense, and of a lesser volume than the heat conductive medium at each level above the base. As can be observed by reference to FIG. 3, the heat conductive medium at higher levels (i.e., closer to the microwave source 304) will tend to get hotter, and therefore become less dense than the medium below it. As can be seen by reference to FIG. 2, as the first and second pipes 106, 104 approach the upper, or broader base of the heat exchanger 300, they form a widening path. The higher level pipes therefore contain a greater intensity of heat carried in a greater volume of heat conductive medium. This temperature, density, and volume gradient, which creates a thermal siphon effect, tends to move the heat conductive medium from inlet 100 to outlet 200 without the use of a motor.

Figure 4:
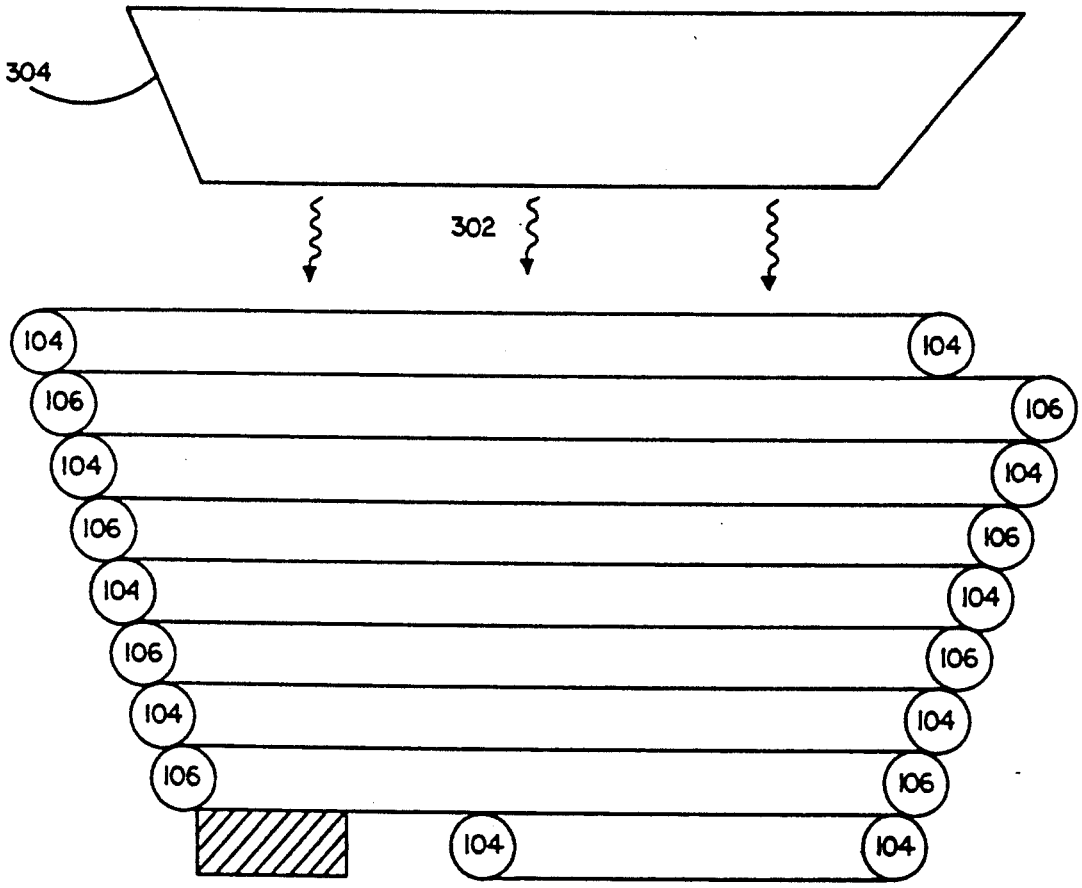
FIG. 4 is a side view of the frusta-pyramidal heat exchanger facing block 108.

As can be seen by reference to FIGS. 3 and 4, the parallel paths on the front and back of the heat exchanger are inclined at a slight angle while the paths on the sides of the heat exchanger do not incline. Advantageously, these alternate inclining and straight paths add to the lift created by the thermal siphon effect by increasing the temperature gradient of the medium between the piping levels. Any angle greater than 8° from horizontal will assist the thermal siphon effect.

Alternatively, a helically wound, inverted conical frustum shape could be utilized in which case the pipes would incline circularly up at each level and would also reap this advantage. In tests conducted by the inventor, an inverted frusta-pyramidal heat exchanger proved capable of heating water about 15% faster than a heat exchanger of an inverted conical type. This can be more easily understood when it is considered that each rung of the preferred frusta-pyramidal heat exchanger is generally in the shape of a square while each rung of an inverted conical heat exchanger would be generally in the shape of a circle.

It will be observed that an inverted frusta-pyramidal shape will naturally have a larger exposed surface area (i.e., more heat-conductive medium will be carried in each rung) than would a conical heat exchanger of a similar size. For example, if a conical-type heat exchanger has a diameter of "D" for any given rung, the perimeter of that rung will be $\pi \times D$. In contrast, the perimeter of a similar sized heat exchanger of the preferred frusta-pyramidal shape would be $4 \times D$. Given that the inner diameter of the pipes would be similar, it can be easily understood that the exposed surface area and the amount of heat-conductive medium carried in the frusta-pyramidal shape would be greater than that for the conical shape.

In order to balance the considerations of flow rate and microwave penetration, and exchange size, pipes with an inner diameter of ½" to 1" should be used. In an embodiment tested by the inventor pipes with an inner diameter of ¾" and an outer diameter of 1" were used. In any event, it is preferred that the inner diameter of the first pipe 106 and the second pipe 104 be the same as that for inlet pipe 100 (i.e., if pipe 100 is 1" then pipes 104 and 106 should each be 1").

It should be understood that larger inner diameter pipes will also perform but may be less efficient. Larger pipes will also increase the overall size of the microwave heat exchanger. The matching of pipe diameters, combined with the split media flow path serves to reduce or eliminate the internal shadow effect and to increase energy absorption within each conduit.

The described construction will give the heat exchanger an inverted, frusta-pyramidal shape. In one embodiment tested by the inventors, the heat exchanger was approximately 10 ¾" from base to base. The broader base formed a 13"×13" rectangle, and each side inclined toward the narrower base at 30°. It is preferred that the heat exchanger be as large as the microwave source and enclosure will allow. Almost any dimension will allow for some heating. It should be understood that an inverted, truncated frusta-conical shape will also function.

The piping used in the heat exchanger will be dependent on the application. A table of piping materials and appropriate operating temperature and pressure ranges may be seen below.

| Piping Material | Temp. Range | Max. Pressure |
|---|---|---|
| Fiberglass resin with glass fiber reinforcements, resin has high content of silicon | Ambient to 225° F. | 230 PSI |
| Glass (Corning Ware ® type) vented | Ambient to 550° F. circulating system | *Open |
| CPVC ® | Ambient to 170° F. | 100 PSI |
| Ceramic vented | Ambient to 700° F. circulating system | *Open |
| PVC | Ambient to 135° F. | 75 PSI |

*Open vented system means, in this case, that the system will utilize an expansion tank that is vented to atmosphere to maintain an equal barometric pressure within the system and allow for heat expansion and cooling contraction of the fluids in said system.

The choice of heat conductive medium will be largely determined by application. For example, in a hot water heating environment the treated or distilled water to be heated is also, preferably, the heat conductive medium. Water may also be the preferred medium in many residential heating and cooling applications. For high temperature applications (i.e., 200°–700° F.), a heat conductive medium such as Dow-Therm ®, available from the Dow Chemical Company, may be used. Syn-Therm 44, available from Temperature Products Incorporated, may also be used in this case.

Figure 5A:
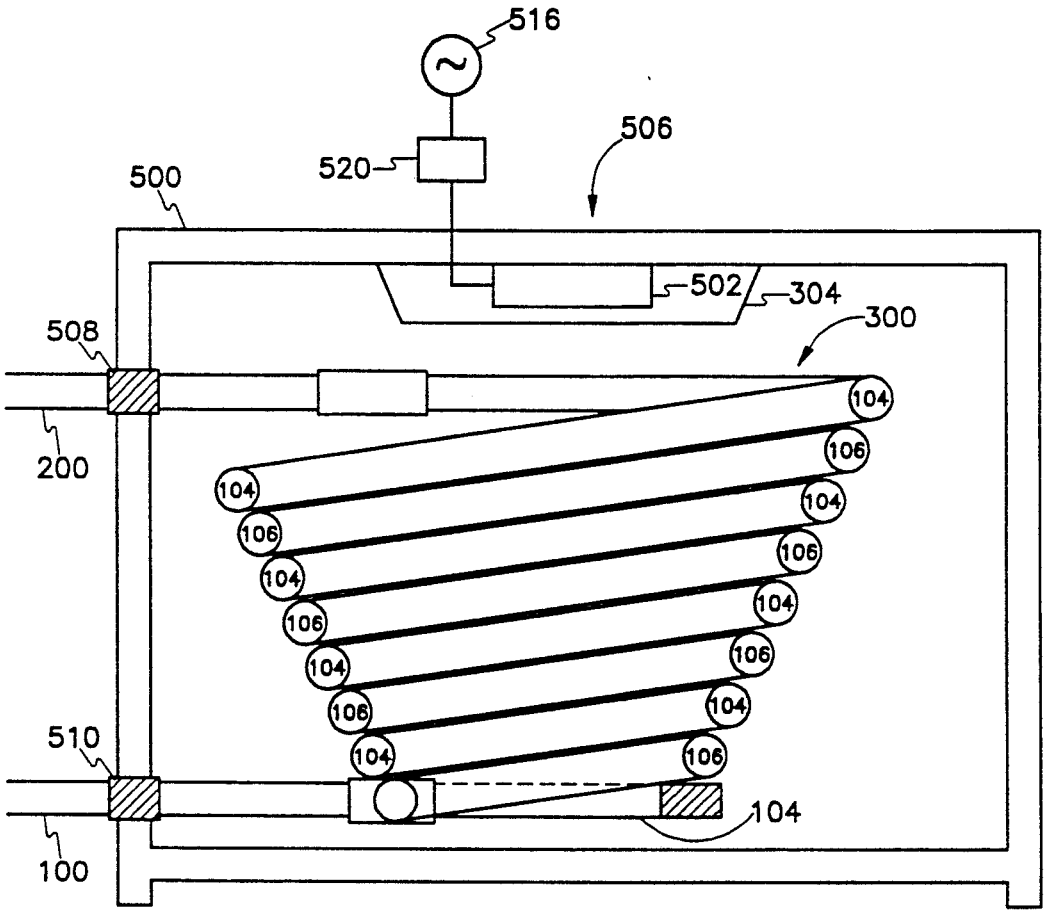
FIGS. 5A–5F are views of the frusta-pyramidal heat exchanger placed within a modified microwave oven having one or more magnetrons.

In order to use the inventive heat exchanger 300, it must be placed with its broader base 306 facing the microwave source 304. Referring to FIG. 5A, the heat exchanger 300 is shown installed within a microwave oven 500 with the broad base 306 of the heat exchanger 300 facing and parallel to the microwave source 304. The microwave source 304 comprises a single magnetron 502. (This heat exchanger/microwave assembly is generally referred to by reference numeral 506.)

To install the heat exchanger 300 into conventional microwave oven 500, two holes, 508 and 510, must be drilled through the side of the oven 500. The inlet pipe 100 and outlet pipe 200 must be passed through the holes 510 and 508 and the unit resealed. The pipes 100 and 200 must be sealed to the oven at the holes 510, 508 in such a manner as to prevent or minimize leakage. Such sealing techniques are well known to those skilled in the art.

The operation of microwave source 304 with respect to the inverted frusta-pyramidal/frusta-conical heat exchanger 300 will now be described. In addition to the magnetron 502, the microwave source 304 comprises a control themostat switch 520.

The control thermostat switch 520 regulates the flow of power from commercial power 516 to the magnetron 502. Specifically, the control thermostat switch 520 monitors a temperature of an application with which the microwave oven 500 is associated, such as a hot water heater. When heat is required within the application, the control thermostat is switch 520 closes to allow power to flow from commercial power 516 to the magnetron 502, thereby causing the magnetron 502 to operate.

The magnetron 502 continues to operate until the control themostat switch 520 senses that further heat within the application is not required. Upon sensing this event, the control themostat switch 520 opens to interrupt the flow of power from commercial power 516 to the magnetron 502, thereby causing the magnetron 502 to stop operating.

The magnetron 502 produces heat as an unwanted byproduct of its operation. The heat increases the operating temperature of the magnetron 502. The magnetron 502's efficiency decreases as its operating temperature rises. Generally, a magnetron's efficiency may decrease by as much as 10% as it nears its maximum safe operating temperature. Operating the magnetron unit beyond its maximum safe operating temperature, in addition to being inefficient, may result in premature failure of the magnetron unit.

A cooling fan (not shown in FIG. 5A) is provided to cool the magnetron 502. The cooling fan operates while power flows to the magnetron 502. Due to the relatively slow rate at which the magnetron 502 dissipates heat, however, the cooling fan cannot completely eliminate the rise in the operating temperature of the magnetron 502. Therefore, for applications which require a continuous supply of microwaves from the microwave source 304, the performance, efficiency, and operating lifetime of the magnetron 502 may be degraded due to the heat produced as an unwanted byproduct of the operation of the magnetron 502.

Microwave oven units containing a plurality of magnetron units and related wave guides may be used with the inverted frusta-pyramidal/frusta-conical heat exchanger 300. As described below, the use of microwave oven units containing multiple magnetrons solves the operating temperature problem.

An example of a microwave oven containing multiple magnetrons is heavy volume microwave oven number 3H270 manufactured by Sharp Inc., and available from W. W. Granger Inc. of Chicago, Ill. Other suitable units are also commercially available.

Figure 5B:
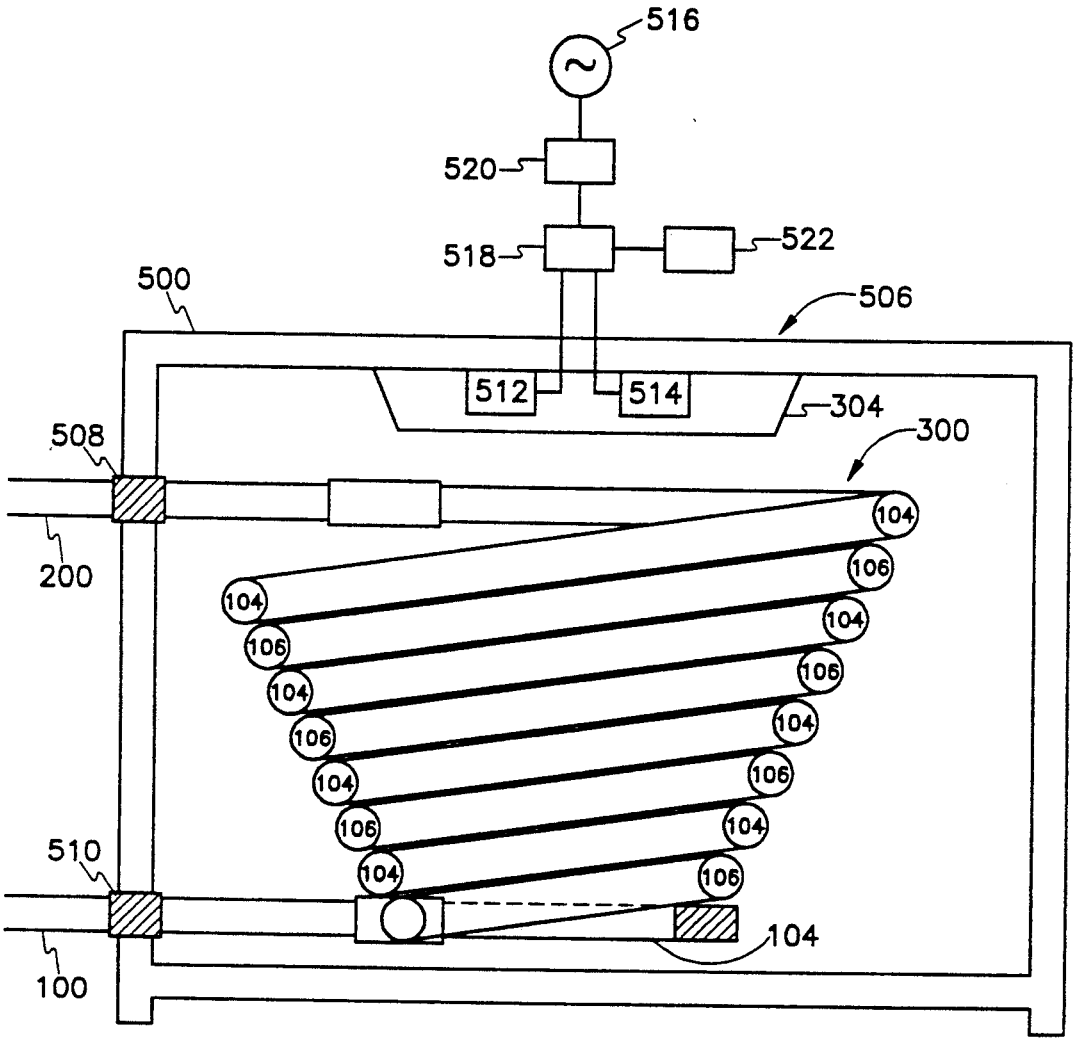

FIG. 5B shows the inverted frusta-pyramidal/frusta-conical heat exchanger 300 installed in the microwave oven unit 500. The microwave source 304 of microwave oven 500 includes magnetrons 512 and 514. Operation of the magnetrons 512 and 514 is controlled by a line voltage power relay 518, the control thermostat switch 520, and a demand themostat 522.

The control thermostat switch 520 controls the flow of power from commercial power 516 to the power relay 518. Specifically, the control thermostat switch 520 senses the temperature within the application with which the microwave oven 500 is associated, such as a hot water heater. When the control thermostat switch 520 senses that heat is required within the application, the control thermostat switch 520 closes to allow power to flow from commercial power 516 to the power relay 518.

Initially, the power relay 518 supplies power from commercial power 516 to the magnetron 512, thereby causing the magnetron 512 to operate. The demand themostat 522 monitors the operating temperature of the magnetron 512. The demand thermostat 522 preferably senses the heat radiation (cooling) fins (not shown in FIG. 5B) attached to the magnetron 512. When the magnetron 512 reaches its maximum safe operational temperature, the demand thermostat 522 commands the power relay 518 to switch power to the magnetron 514, thereby interrupting the power to and the operation of the magnetron 512.

The magnetrons 512 and 514 are cooled by a cooling fan (not shown in FIG. 5B) which is constantly operating while power is flowing to the magnetron 512 or 514. In the preferred embodiment of the present invention, when demand thermostat 522 senses a sufficient drop in temperature of the magnetron 512, the demand thermostat 522 commands the power relay 518 to switch power back to the magnetron 512.

The temperature at which the demand thermostat 522 reactivates the magnetron 512 is adjustable and will ultimately depend on the microwave requirements and the load associated with the specific application. For example, the demand thermostat 522 may be adjusted to reactivate the magnetron 512 when the magnetron 512 reaches ambient temperature.

As will be obvious to those skilled in the art, a second demand thermostat could be added to the control circuitry of FIG. 5B. The second demand thermostat, working with the demand thermostat 522, would sense the operating temperature of the magnetron 514 and reactivate the magnetron 512 once the magnetron 514 reached its maximum safe operating temperature. Alternatively, a time delay device could be added to the control circuitry of FIG. 5B. The time delay device would ensure that the magnetron 512 would not be reactivated for a given amount of time, such as 30 minutes (the time could be adjusted).

The cyclic process of alternating power and operation between the magnetrons 512 and 514 continues until the control thermostat switch 520 senses that no further heat is required in the application. Upon the occurrence of this event, the control thermostat switch 520 enters an open state, thereby discontinuing the flow of power from commercial power 516 to the power relay 518.

The inverted frusta-pyramidal/frusta-conical heat exchanger 300 can operate within microwave oven units containing any number of magnetron units in a manner similar to that described above with reference to FIG. 5B. At present, the inventor has used up to 4 magnetrons, but the inventor knows of no theoretical or practical reasons why more magnetrons cannot be used.

The magnetron units can operate individually in a sequential manner (as in FIG. 5B). The magnetron units can also be divided into sets, where the sets operate sequentially (and where the magnetron units within a set operate in parallel when the set is activated). This arrangement is described below with reference to FIG. 5C. The number of magnetron units is governed only by the energy requirements of the application.

Figure 5C:
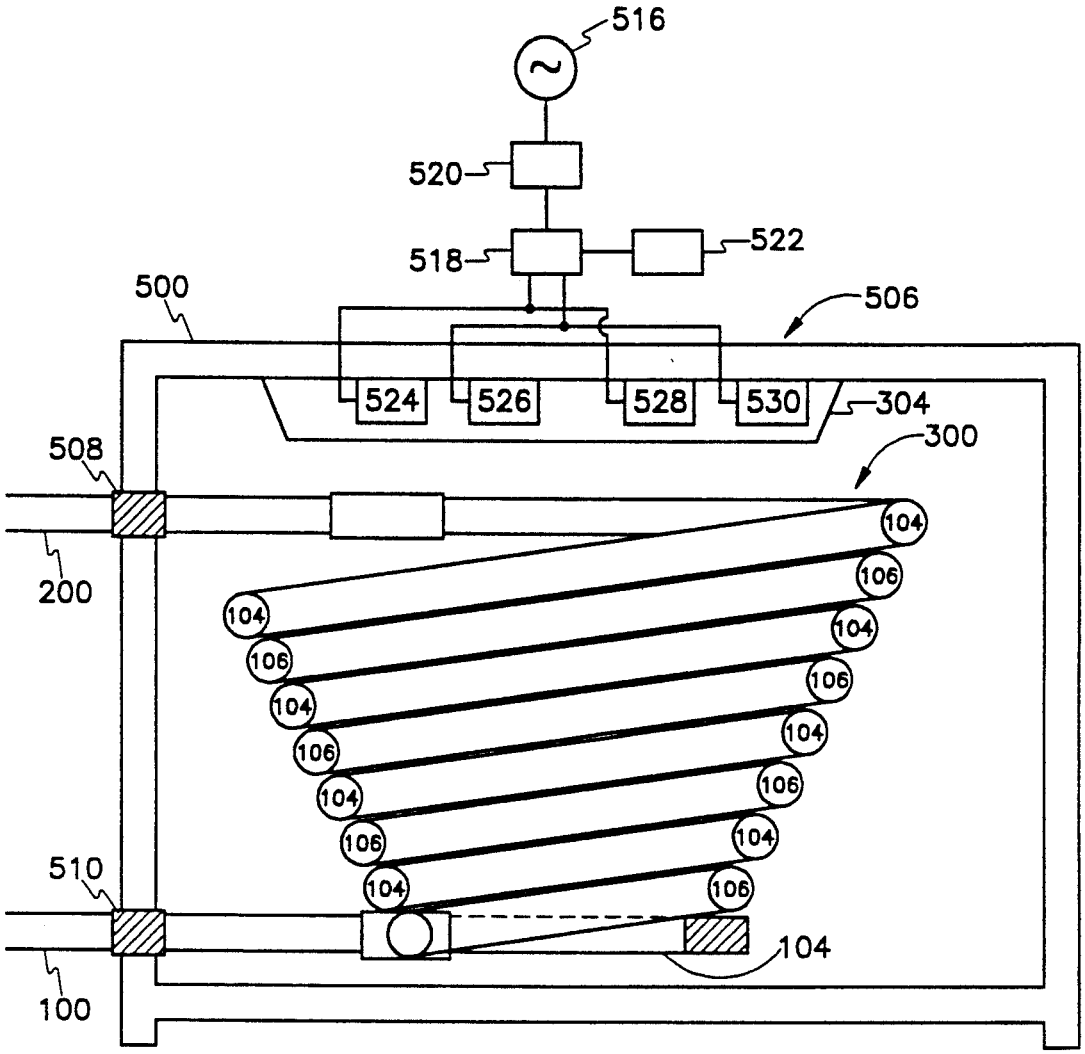

FIG. 5C shows the inverted frusta-pyramidal/frusta-conical heat exchanger 300 installed in the microwave oven unit 500 with the microwave source 304 comprising magnetrons 524, 526, 528, and 530. The four magnetrons of microwave source 502 are divided into two sets. Magnetron Set 1 is composed of the magnetrons 524 and 528. Magnetron Set 2 is composed of the magnetrons 526 and 530.

Figure 5D:
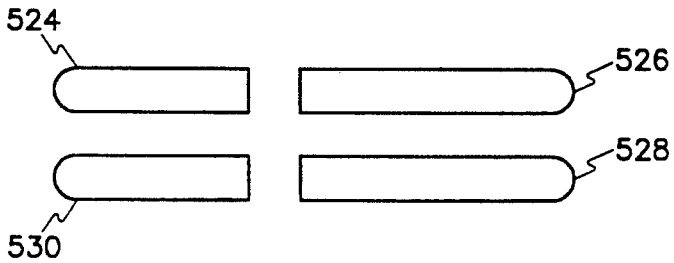

Generally, when using microwave sources with multiple magnetrons, it is necessary to position the magnetrons to achieve maximum microwave contact with the inverted frusta-pyramidal/frusta-conical heat exchanger 300. With respect to the four magnetrons of FIG. 5C, the magnetrons within each set should be oppositely positioned on a diagonal, as shown in FIG. 5D. This ensures maximum microwave contact with the inverted frusta-pyramidal/frusta-conical heat exchanger 300.

As with the example presented above with respect to FIG. 5B, operation of the magnetrons 524, 526, 528, and 530 is controlled by the line voltage power relay 518, the control thermostat switch 520, and the demand themostat 522.

When heat is required within the application, such as a hot water heater, the control thermostat switch 520 causes power to flow from commercial power 516 to the power relay 518. Initially, the power relay 518 directs power to Magnetron Set 1, thereby causing the magnetrons 524 and 528 to operate in parallel. When the demand thermostat 522 senses that the magnetrons 524 and 528 are at their maximum safe operating temperature, the demand thermostat 522 commands the power relay 518 to switch power to Magnetron Set 2, thereby interrupting power to and the operation of the magnetrons 524 and 528, and causing the magnetrons 526 and 530 to operate in parallel.

The demand themostat 522 commands the power relay 518 to switch power back to Magnetron Set 1 when the operating temperature of Magnetron Set I falls to an acceptable level (for example, ambient temperature). This cyclic process continues as long as the control themostat 520 senses that heat is required within the application.

Although this example was presented with only two magnetron sets, each magnetron set containing two magnetrons, it should be obvious to one with ordinary skill in the art that this process would work equally well with any number of magnetron sets and with any number of magnetrons in each magnetron set. In these arrangements, the magnetron sets would operate sequentially, and the magnetrons within each magnetron set would operate in parallel. Such arrangements would require additional demand thermostats and power relays (or a single power relay with additional switching contacts).

Figure 5E:
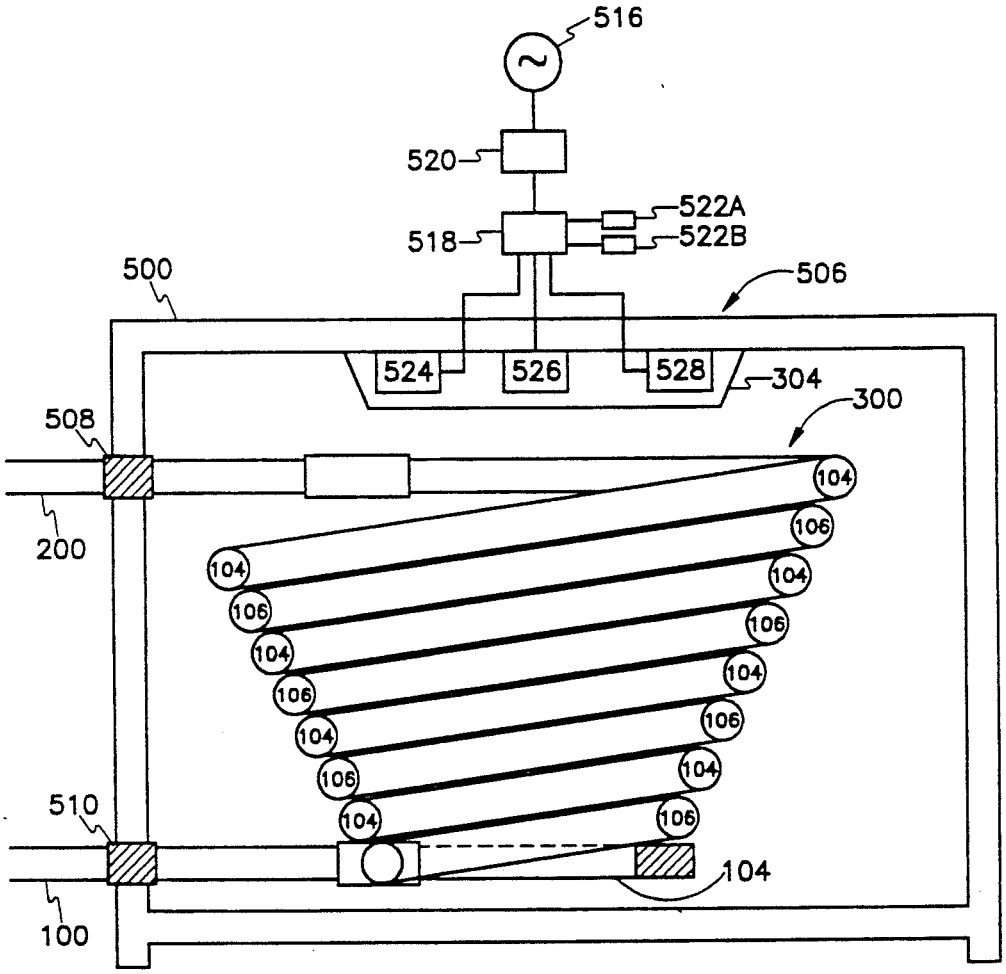

For example, FIG. 5E shows the inverted frusta-pyramidal/frusta-conical heat exchanger 300 installed in the microwave oven unit 500 with the microwave source 304 comprising magnetrons 524, 526, and 528. Unlike FIG. 5C, the magnetrons 524, 526, and 528 each represent a magnetron set. Thus, they operate sequentially.

The power relay 518, having three switching contacts, regulates the flow of power from commercial power 516 (and control thermostat 520) to the magnetrons 524, 526, and 528. Initially, the power relay 518 directs power to the magnetron 524. Demand thermostat **522*a* commands power relay 518 to switch power to the magnetron 526 when the magnetron 524 reaches its maximum safe operating temperature. Likewise, demand thermostat 522***b* commands power relay 518 to switch power to the magnetron 528 when the magnetron 526 reaches its maximum safe operating temperature.

The demand thermostats 522*a* and 522*b* command the power relay 518 to switch power back to their respective units once the operating temperatures of their respective units fall to acceptable levels (for example, ambient temperature). The demand thermostats 522*a*, 522*b* can be wired to give priority to demand themostat 522*a*.

The use of microwave ovens containing multiple magnetrons as described above with reference to FIGS. 5B, 5C, 5D, and 5E solves the operating temperature problem as described above with reference to FIG. 5A. Using a cyclic process to switch operation among magnetron sets ensures that the magnetrons operate within the boundaries of their maximum safe operating temperatures. Thus, the performance, efficiency, and longevity of the magnetrons are maximized (with respect to their respective loads).

The example presented above with respect to FIG. 5B is described in greater detail below with reference to FIG. 5F.

Figure 5F:
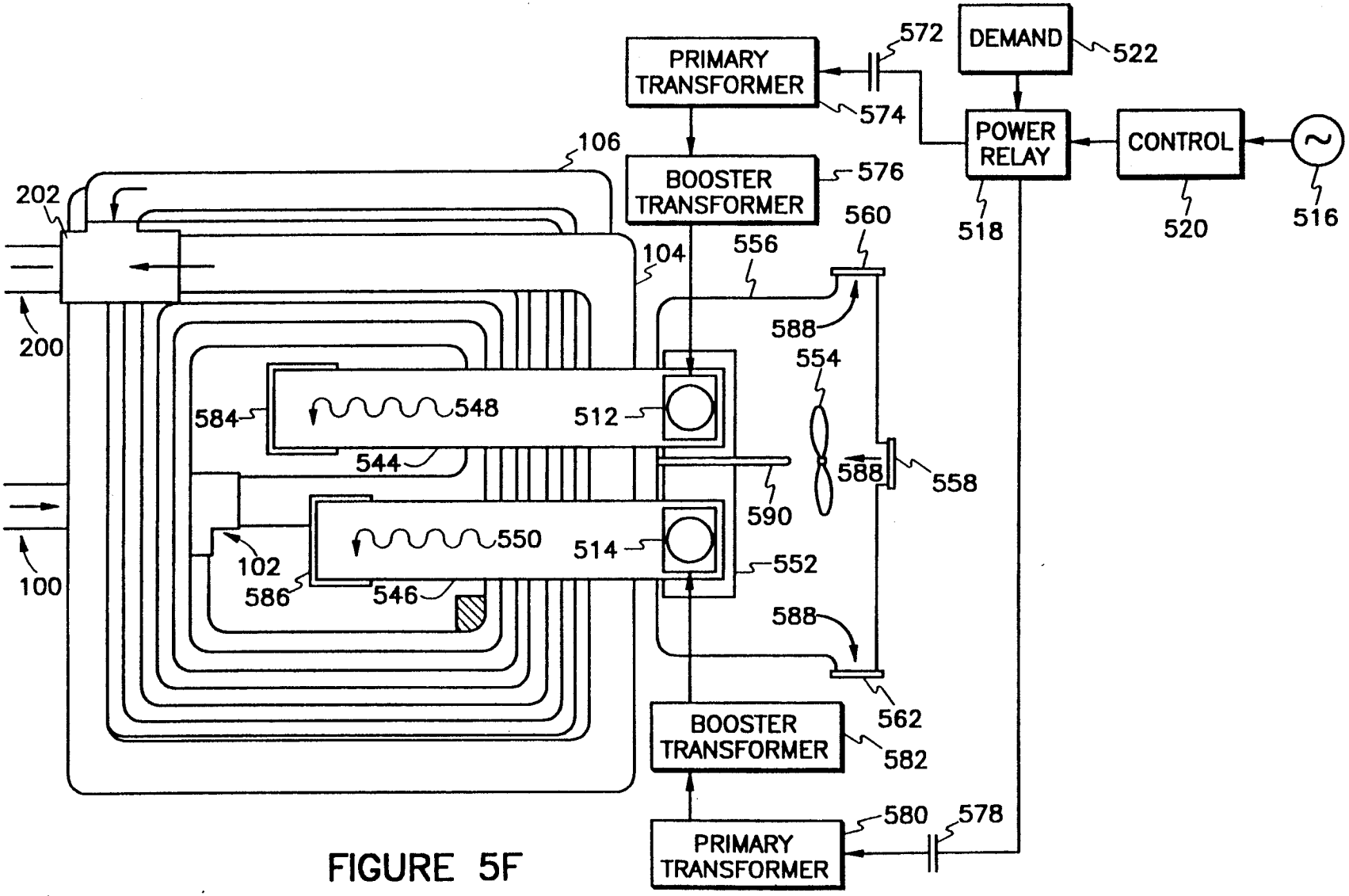

FIG. 5F is a top view of the inverted frusta-pyramidal/frusta-conical heat exchanger 300 installed within microwave oven unit 500 that was originally presented in FIG. 5B. In addition to showing the components from FIG. 5B, FIG. 5F shows further details of the microwave source 304. For clarity, the outer structure of microwave oven 500 and the two holes 508 and 510 are omitted from FIG. 5F. The thick arrowed lines in FIG. 5F represent the flow of power within the microwave source 304.

As shown in both FIGS. 5B and 5F, the microwave source 304 includes the magnetrons 512 and 514, control themostat switch 520, demand thermostat 522, and line voltage power relay 518. The control thermostat switch 520 is located in, at, or upon the unit requiring heat (not shown in FIGS. 5B and 5F). For example, the control themostat switch 520 may be mounted on a wall of a hot water tank. The remaining items above are contained in a separate chamber (not shown in FIGS. 5B and 5F) which is adjacent to the microwave oven 500.

These items are readily available from commercial sources. For example, the control thermostat switch 520 and demand thermostat switch 522 are manufactured by Dayton Electric Company and are distributed by W. W. Granger Company (Catalog No. 2E050). The line voltage power relay unit 518 is either available from W. W. Granger (Catalog No. 6X563) or from another supplier who supplies relays rated to switch 20 amp or greater loads at 120 volts a.c.

As shown in FIG. 5F, the microwave source 502 also includes waveguides 544 and 546, primary transformers 574 and 580, booster transformers 576 and 582, capacitors 572 and 578, magnetron cooling cavity 556, magnetron heat radiation cooling fins 552, cooling fan 554, air, filter 558, exhaust screens 560 and 562, and air flow divider 590. Other than the waveguides 544 and 546, these items are also contained in the separate chamber that was described above. These items are readily available from commercial sources. For example, the cooling fan 554 is manufactured by Dayton Electronic Company (Catalog No. 4C720).

The operation of the microwave source 304 with respect to the inverted frusta-pyramidal/frusta-conical heat exchanger 300 will now be described.

Upon sensing the need for heat in the application, such as a hot water heater, the control thermostat switch 520 causes power to flow from commercial power 516 to the power relay 518. The control thermostat switch 520 simultaneously causes power to flow to the cooling fan 554, thereby causing the cooling fan 554 to operate (the connection between the control thermostat switch 520 and cooling fan 554 is not shown in FIG. 5F).

The demand thermostat switch 522 controls the operation of the power relay 518. Initially, the demand thermostat switch 522 commands the power relay 518 to direct power to the magnetron 512 by way of the capacitor 572, primary transformer 574, and booster transformer 576. The magnetron 512 responds by generating microwaves 548. The microwaves 548 travel through the waveguide 544 to an aperture 584. The microwaves 548 exit the waveguide 544 at the aperture 584 and enter the inner cavity of the inverted frusta-pyramidal/frusta-conical heat exchanger 300, thereby raising the temperature of the fluids contained within the inverted frusta-pyramidal/frusta-conical heat exchanger 300.

The demand thermostat switch 522 senses the operating temperature of the magnetron 512 at the cooling fin 552. When the magnetron 512 reaches its maximum safe operating temperature, the demand themostat 522 commands the power relay 518 to switch power to the magnetron 514 via the capacitor 578, primary transformer 580, and booster transformer 582. The magnetron 512 thereby begins to supply microwaves 550 to the inverted frusta-pyramidal/frusta-conical heat exchanger 300 via the waveguide 546 and aperture 586.

The cooling fins 552, cooling fan 554, and air flow divider 590 operate to cool the magnetrons 512 and 514. Specifically, heat produced by the magnetrons 512 and 514 flow from the magnetrons 512 and 514 to the cooling fins 552. The cooling fan 554 forces cooling air 588 through air filter 558 to the cooling fins 552, thereby cooling the cooling fins 552 and the magnetrons 512 and 514. The air flow divider 590 establishes equal and uniform air flow to the magnetrons 512 and 514. The cooling air 588 then exits the magnetron cooling cavity 556 via the exhaust screens 560 and 562.

When the demand thermostat 522 senses a sufficient drop in temperature (for example, to ambient temperature) of the magnetron 512, the demand thermostat 522 commands the power relay 518 to switch power back to, the magnetron 512.

This cyclic process of alternating power and operation between the magnetrons 512 and 514 continues until the control themostat switch 520 sensed that no further heat is required in microwave oven 500. Upon the occurrence of this event, the control thermostat switch 520 enters an open state, thereby discontinuing the flow of power from commercial power 516 to the power relay 518.

Although the example in FIG. 5F was presented with only two magnetrons, in light of FIGS. 5B, 5C, 5D, and 5E and the text above, it should be obvious to one with ordinary skill in the art that this process applies equally well to systems which contain multiple magnetron sets, each of the magnetron sets containing multiple magnetrons. In these arrangements, the magnetron sets would operate sequentially and the magnetrons within each magnetron set would operate in parallel.

The following sections describe the operation of the inverted frusta-pyramidal/frusta-conical heat exchanger 300 with reference to specific applications. It should be noted that, consistent with the discussion above with reference to FIGS. 5A, 5B, 5C, 5D, 5E, and 5F, the microwave source 304 as referenced herein may include any number of magnetron sets, each magnetron set containing any number of magnetrons. The number of magnetrons actually used depends on the specific energy requirements of the application.

III. Residential/Commercial Hot Water Heating Embodiment

Figure 6:
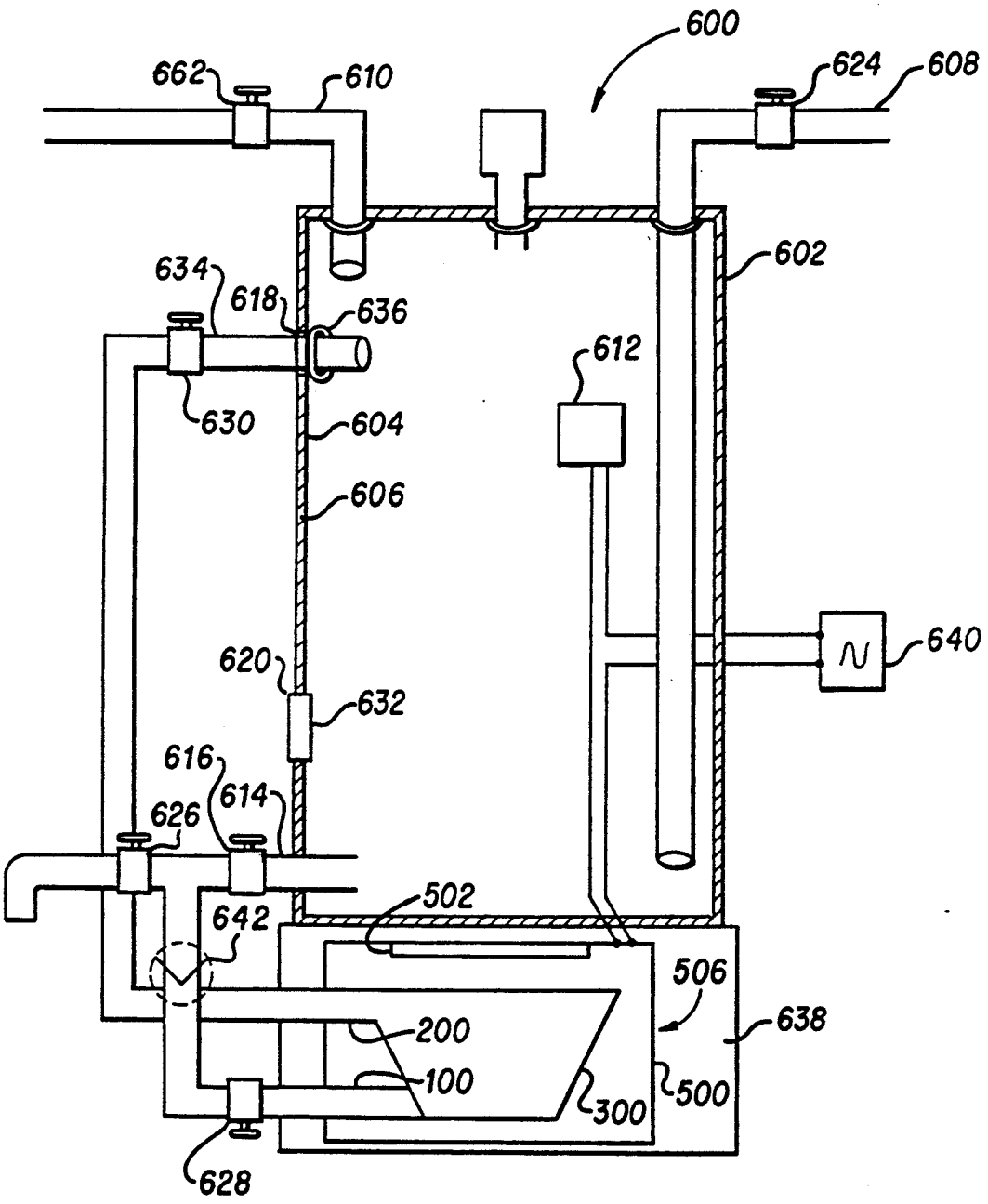
FIG. 6 shows the frusta-pyramidal heat exchanger used in conjunction with a modified conventional hot-water heating system.

Referring to FIG. 6, the inventive heat exchanger is shown as part of a residential hot water heating device.

A conventional hot-water tank 600 is shown with its outer metal wall 602, an inner tank 604, and insulation 606. The cold water supply enters the hot-water tank 600 by passing through the cold water supply pipe 608. Hot water exits the tank through the hot water service pipe 610. A themostat 612, a drainpipe 614, and a first service valve 616 on the drainpipe are also shown. Many conventional hot-water tanks also have openings such as shown by reference numerals 618 and 620 for the purpose of securing upper and lower heating elements to the tank. Service valves 622, 624, 626, 628 and 630 are also shown in FIG. 6. During operation of the water heater drain service valve 626 is normally left closed. The remaining valves are normally left open (i.e., water is allowed to flow through them).

In order for the tank to be used with the inventive heat exchanger, the hot water tank's lower orifice 620 is sealed with a plug 632. A return pipe 634 is placed into the upper orifice 618 and sealed with a fitting and seal 636. The heat exchanger/microwave assembly 506 (shown schematically) is placed within a dead space 638 underneath tank 600. Where not provided by the manufacturer, a dead space could be created by lifting the tank above a suitable structural sheet-metal enclosure. As an alternative, the heat exchanger/microwave assembly may be placed alongside the hot water tank.

In operation, the hot water tank 600 is filled with cold water supplied under pressure through the cold water supply pipe 608. When the thermostat 612 senses that the temperature of the water within tank 600 is below its threshold, it turns on the conventional microwave unit 500 by applying power from an A.C. source 640. (The wiring of thermostats is well known to those skilled in the art.) In the preferred embodiment, the system also consists of an optional pump 642 which is similarly turned on by the thermostat 612.

Once the microwave unit 500 and pump 642 (if present) are turned on, cold water is pumped from the hot water tank 600 through the drain pipe 614, the first valve 616, the optional pump 642, the inlet pipe 100 and into the heat exchanger 300. Within the heat exchanger, the flow of the water supply is split into the first and second pipes 106, 104. The water within the heat exchanger 300 is carried up toward the microwave source 304 in a split pattern of broadening perimeter and heated by microwaves as it rises. Hot water from the top of the heat exchanger 300 exits through the outlet pipe 200 and travels through the return pipe 634 into hot-water tank 600. Circulation continues until the thermostat 612 senses that the temperature of the water in the hot water tank 600 has risen above its threshold, at which point power to the microwave unit 500 and optional pump 642 is shut off. When there is a demand for hot water, it is drawn from the hot water tank 600 through the hot water service pipe 610. It is replaced by cold water which enters the hot-water tank at the bottom through cold water supply pipe 608. When the thermostat 612 senses that the water temperature has again dropped below its threshold level, power to the microwave unit 500 and optional pump 642 is again turned on.

The optional pump 642 may be eliminated from the system. In this case, when the thermostat 612 turns on the microwave unit 500, water is drawn into the heat exchanger 300 by the thermal siphon effect created by the shape of the heat exchanger 300 and the temperature gradient of the water therein.

It should be understood that in the absence of a dead space beneath the hot water tank 600, the heat exchanger/microwave unit assembly 506 may be placed along side the tank and the plumbing routed accordingly.

When desired, the drain valve 626 may be used to drain the tank for servicing in accordance with standard hot water tank maintenance procedures.

IV. Residential/Commercial Heating Embodiments

Figure 7:
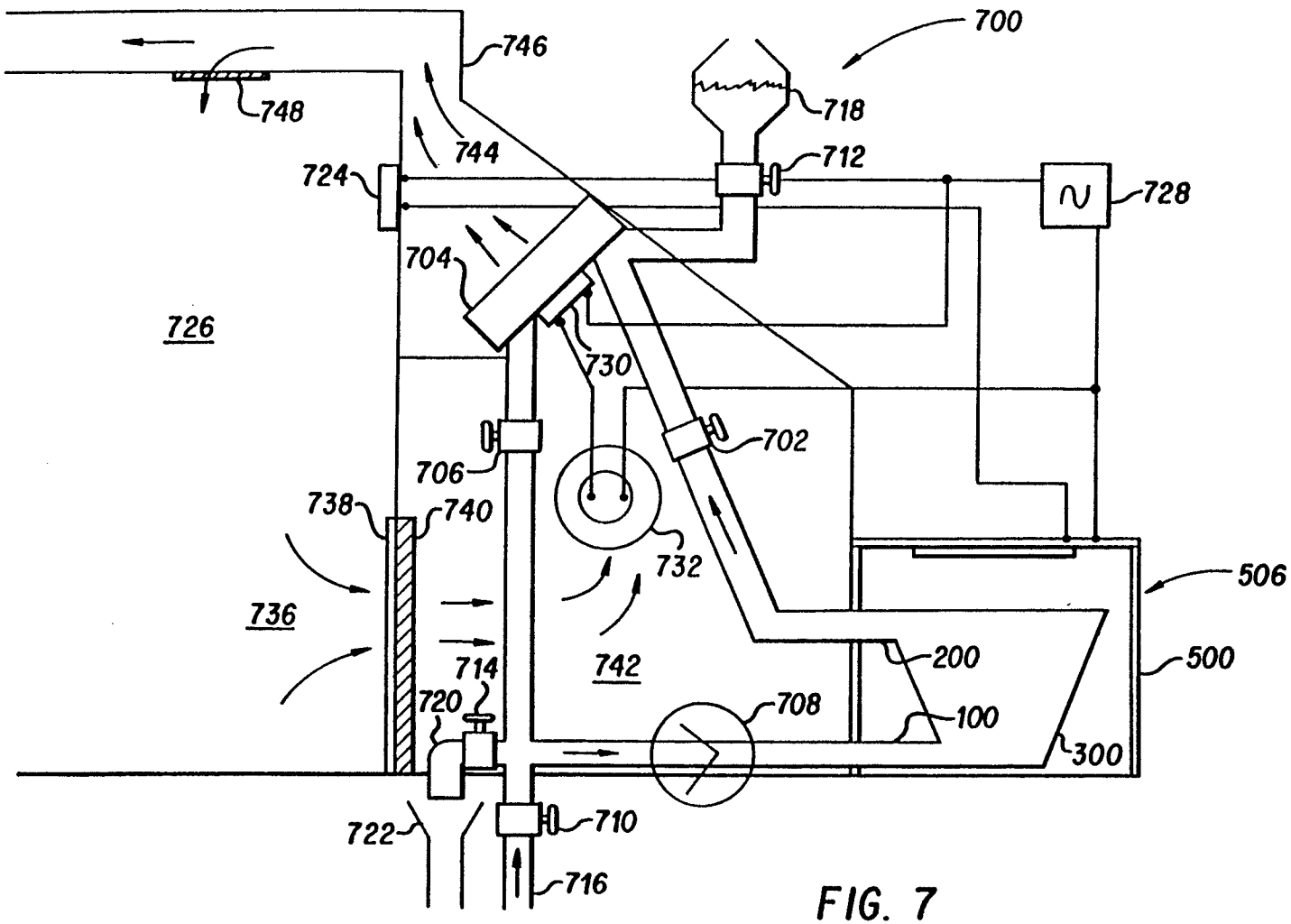
FIG. 7 shows the inverted frusta-pyramidal heat exchanger used in conjunction with a residential/commercial heating system.

Referring to FIG. 7, the inventive heat exchanger is shown as part of a forced hot-air heating system 700. The heat exchanger 300 is placed within a conventional microwave unit 500 to form the heat exchanger/microwave assembly 506 as has been previously described. The heat-conducting medium, preferably treated water or DOW-THERM ® in this case, travels through the flow path defined by the heat exchanger 300, outlet pipe 200, first flow path valve 702, heating coil 704, second flow path valve 706, optional motor driven pump 708, and the inlet pipe 100. The system may be initially filled by opening the cold water supply valve 710, closing the drain valve 714, and allowing water to flow in from the cold water inlet pipe 716. In order to fill the system, the expansion tank shutoff valve 712, (which leads to the vented fluid expansion tank 718), must be open, as well as the first and second flow path valves 702, 706. The system is filled until fluid enters the fluid expansion tank 718 at which point the inlet valve 710 is shut off. In operation, the valves remain as they were during filling except that the cold water supply valve 710, is closed.

The fluid expansion tank 718 allows for fluid expansion and contraction during operation and shutoff periods of the system. A shutoff valve 712 is provided for servicing of the expansion tank. As can be seen from FIG. 7, the fluid expansion tank 718 should preferably attach to the system at its highest point of flow. The first and second flow path valves 702, 706 are used for flow control or isolation of the system. A drain valve 714, drain pipe 720 and a facility drain are used to drain down the system for servicing.

In operation, the room thermostat 724 senses the temperature of the area to be heated 726. When the temperature at the room thermostat 724 falls below a predetermined threshold, power from the AC source 728 is applied to the microwave unit 500 and optional pump 708. In the preferred embodiment, the optional pump 708 is placed at the inlet 100 of the heat exchanger 300. In this case, power from the AC source 728 is supplied to the pump 708 through the operation of the room thermostat 724 at the same time that it is supplied to the microwave unit 500.

The pump 708 and the thermal siphon effect created by the heat exchanger 300 (when heated by microwaves) causes the heat-conductive medium to move along the defined flow path. The heat-conductive medium is heated within the heat exchanger 300 and then passed through a heating coil 704. The heating coil 704 is preferably of a known type made of copper tubing with heat transfer fins (for example, Dayton "A" or "H" type heat exchangers, available from W. W. Grangers Supply Company) or other compatible manufacturer. As the heated water flows through the heating coil 704, the heating coil transfers heat to a heating coil thermostat 730. The heating coil thermostat 730 is installed with a capillary sensing tube attached to the heat exchanger coil 704. When the temperature at the heating coil thermostat 730 rises to a predetermined threshold, power is applied to the centrifugal fan 732. The preferred range for the predetermined threshold (for the heating coil thermostat) is from about 120°-200° F. with 125° being preferred for residential applications. Advantageously, the use of the heating coil themostat 730 prevents the circulation of unheated air by causing the centrifugal fan not to function until the heating coil attains the proper temperature. When the centrifugal fan is turned on, cool air 736 is drawn through the intake register 738 and filter 740 by the centrifugal fan 732 into the heating compartment 742. The cool air is then forced through the heating coil 704 by the centrifugal fan 732 and forced in the direction indicated by the arrows 744. As the air passes through the heating coil 704, it is heated. The heated air is then blown into a conventional ductwork system 746 by the centrifugal fan 732 and out the hot-air supply register 748.

The hot air being blown through the hot-air supply register 748, as well as any other number of registers which may be in the area to be heated, causes the temperature in the area to be heated 726 to rise. When the temperature measured at the room thermostat 724 rises above the predetermined threshold, power is cut to the pump 708, and the microwave heating unit 500. The power is continued to the centrifugal fan 732 through the heating coil thermostat 730. The centrifugal fan 732 continues to furnish cool air 736, extracting heat from the heating coil 704, until the lower temperature threshold is attained in the heating coil thermostat 730. The heating coil themostat 730 then opens the circuit and power is discontinued to the centrifugal fan 732. This ends the heating cycle. If the thermostat 724 senses that the temperature in the area to be heated 726 has again dropped below its threshold, the cycle begins &gain.

V. Air Conditioning Embodiment

The inverted frusta-pyramidal/frustra-conical heat exchanger 300 may be used in conjunction with a known ammonia, hydrogen absorption refrigeration system and other systems with similar gases. The refigeration system of the present invention may be used, for example, in ice making, cold storage, and air conditioning applications. In refigeration applications such as these, a DOW-THERM® heat conductive medium, available from the Dow Chemical Company, is preferably used as the liquid medium contained within the inventive heat exchanger 300.

Figure 9:
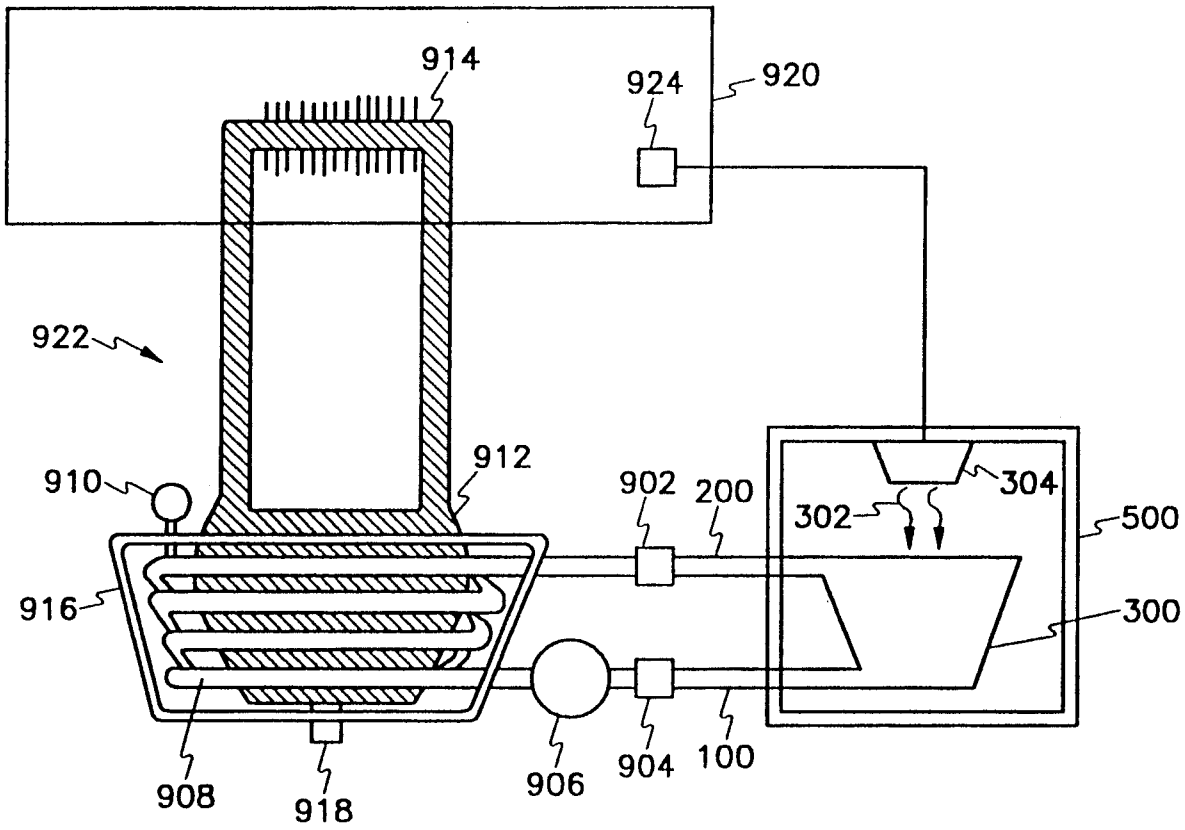
FIG. 9 shows the inverted frusta-pyramidal heat exchanger used in conjunction with a refigeration system.

Referring to FIG. 9, the inverted frusta-pyramidal/-frustra-conical heat exchanger 300 is shown as part of a known Electrolux-Servel refigeration system 922. The Electrolux-Servel refigeration system 922 represents an ammonia, hydrogen absorption refigeration system. The Electrolux-Servel refigeration system 922 is described in *The Standard Handbook for Mechanical Engineers* by Baumeister and Marks, pages 18-13, 18-14, McGraw Hill, Seventh Edition, 1967, which is herein incorporated by reference in its entirety. A conventional Electrolux-Servel refigeration system 922 includes a generator 912 and a heat exchanger 914. The generator 912 contains a mixture of ammonia and hydrogen. The conventional Electrolux-Servel refigeration system 922 also includes a conventional heating source, such as kerosene, natural gas, or alcohol flame or electric heating coils (not included in FIG. 9). As shown in FIG. 9, however, in a preferred embodiment of the present invention, the inverted frusta-pyramidal/-frustra-conical heat exchanger 300 is used as the heating source. Use of the inventive heat exchanger 300 significantly lowers the operating costs of the Electrolux-Servel refigeration system 922.

In the preferred embodiment of the present invention, the generator 912 is encased within a copper heat exchanger 908. The copper heat exchanger 908 is formed to physically contact the generator 912 and may be bonded by brazing to generator 912 for better heat transfer. The generator 912 and the copper heat exchanger 908 are placed within an insulated housing 916. The generator 912, the copper heat exchanger 908, and the insulated housing 916 are secured to one another by retaining bolts 918.

The inventive heat exchanger 300 is placed within the microwave unit 500 to form the heat exchanger/microwave assembly 506 as described above. For high temperature applications, the heat exchanger 300 may be composed of ceramic or glass tubing.

Inlet 100 and outlet 200 are attached to the copper heat exchanger 908 via copper or brass unions 904 and 902, respectively. As is well known in the art, the copper or brass unions 904 and 902 securely attach ceramic and glass tubing to copper. The copper or brass unions 904 and 902 are readily available from a number of suppliers.

The operation of the inventive heat exchanger 300 with the Electrolux-Servel refigeration system 922 will now be described.

A thermostat 924 detects when an area to be cooled 920 requires cooling. When the area to be cooled 920 requires cooling, the themostat 924 causes the microwave source 304 to generate microwaves 302, thereby heating the fluid in the heat exchanger 300.

The thermal siphoning principle, as described above, causes the fluid in the inventive heat exchanger 300 to flow from the inlet 100 to the outlet 200 to the copper heat exchanger 908. A fluid expansion tank 910, which is vented to the atmosphere for barometric balance, is connected to the copper heat exchanger 908 at the highest point in the system and provides for the expansion and contraction of fluids in the copper heat exchanger 908.

At the copper heat exchanger, the heat from the fluids is transferred to the generator 912, thereby vaporizing the ammonia and hydrogen contained within the generator 912. As is characteristic of the Electrolux-Servel refigeration system 922, the ammonia and hydrogen vapor travel to the heat exchanger 914, where heat is transferred from the area to be cooled 920 to the heat exchanger 914, thereby cooling the area to be cooled 920.

After transferring their heat to the generator 912, the cooled fluids in the copper heat exchanger 908 travel back to the inventive heat exchanger 300 for reheating via the inlet 100. In an alternative embodiment, a pump 906 may be used to assist in the transfer of fluids between the inventive heat exchanger 300 and the copper heat exchanger 908.

The process described above continues as long as the themostat 924 senses that the area to be cooled 920 requires cooling. When cooling is no longer required, the thermostat 924 causes the microwave source 304 to discontinue the generation of microwaves 302.

Although the refigeration example above was presented using an Electrolux-Servel refigeration system, it will be obvious to those with ordinary skill in the art that the inventive heat exchanger 304 could be used with any ammonia, hydrogen absorption refrigeration system and other systems with similar gases.

VI. Conclusion

Many modifications and improvements to the preferred embodiments will now occur to those skilled in the art. In particular, the shape of the heat exchanger may be changed so as to form an inverted three sided pyramid or so as to form an inverted cone. Also, one may split the water flow into more than two paths. For example, the flow paths, may be split so as to climb as triplet or quadruplet. It may al so be seen that the inverted, truncated heat exchanger may be used in many other heating, drying and cooling applications. Therefore, while preferred embodiments of the present invention have been described, these should not be taken as a limitation of the present invention, but only as exemplary thereof; the present invention is to be limited only by the following claims.

What I claim is:

1. A refigeration device comprising:

(1) a generator containing a gaseous medium;

(2) a first heat exchanger connected to said generator such that said gaseous medium can flow between said generator and said first heat exchanger;

(3) a second heat exchanger having a first inlet and a first outlet, said second heat exchanger formed to encase said generator;

(4) an inverted frustum shaped heat exchanger having a microwave source positioned at its broad end, said inverted frustum shape heat exchanger having a microwave-transparent conduit with a second inlet opening at one end and a second outlet opening at another end, said conduit being shaped so as to form a three-dimensional path of widening perimeter from said second inlet to said second outlet openings, said second inlet connected to said first outlet and said second outlet connected to said first inlet such that a circular flow path is established between said inverted frustum shaped heat exchanger and said second heat exchanger;

(5) a heat conductive medium within said circular flow path;

(6) means for causing said microwave source to provide microwaves to said inverted frustum shaped heat exchanger responsive to a temperature in a place to be cooled;

(7) means for causing said heat conducting medium to circulate in said circular flow path when said microwave source is providing microwaves;

wherein when said microwave source is providing microwaves, said heat from said heat conductive medium in said second heat exchanger is transferred to said generator, thereby vaporizing said gaseous medium and causing said vapor to circulate to said first heat exchanger; and wherein heat from said room to be cooled is transferred to said vapor in said first heat exchanger, thereby cooling said room to be cooled.

2. The refigeration device of claim 1, wherein said microwave source comprises:

(i) one or more magnetron sets, said magnetron sets having operating temperatures and maximum safe operating temperatures; and (ii) means for sensing said operating temperatures;

wherein said magnetron sets operate sequentially in a cyclic pattern according to said operating temperatures, such that said respective magnetron sets do not operate when said respective operating temperatures exceed said respective maximum safe operating temperatures.

3. The refigeration device of claim 1, wherein said circulating means comprises a pump.

4. The refigeration device of claim 1, wherein said microwave-transparent conduit comprises ceramic or glass tubing.

* * * * *